United States Patent [19]

Cassidy

[11] Patent Number: 4,526,317

[45] Date of Patent: Jul. 2, 1985

[54] FLIPTOP CARTON

[75] Inventor: Benjamin J. Cassidy, Waldwick, N.J.

[73] Assignee: International Paper Company, New York, N.Y.

[21] Appl. No.: 625,883

[22] Filed: Jun. 29, 1984

[51] Int. Cl.[3] ..... B65B 11/48; B65D 85/10

[52] U.S. Cl. ..... 229/44 CB

[58] Field of Search ..... 229/44 CB

[56] References Cited

U.S. PATENT DOCUMENTS

| | | | |
|---|---|---|---|
| 4,127,229 | 11/1978 | Roccaforte | 229/44 CB |
| 4,392,338 | 7/1983 | Fox | 229/44 CB X |
| 4,466,536 | 8/1984 | Zeitel | 229/44 CB X |

*Primary Examiner*—Steven M. Pollard

*Attorney, Agent, or Firm*—Richard J. Ancel

[57] ABSTRACT

A container for cigarettes or other rod-like elements. The container is in the general form of a rectangular parallelepiped. It is formed by bending and folding a single blank of a suitably cut sheet of paperboard, cardboard or other stiff, resilient and foldable material. It carries a boxlike lid hinged along its rear wall. The inner sides of the lid carry lid guide panels, spaced from the lid sides, with the side portions of certain corner posts slidably positioned between the lid sides and the lid guide panels. In a modification, the corner posts and the upper portion of the front of the main body portion of the container are debossed.

12 Claims, 10 Drawing Figures

FLIPTOP CARTON

This invention relates to containers and more particularly to a container particularly adapted to hold cigarettes, crayons, or other rod-like elements. The container is in the general form of a rectangular parallelepiped. The container is formed by suitably scoring, cutting, bending and folding a one-piece blank, the blank being formed of a sheet of paperboard or other generally stiff, resilient and foldable material.

The container is defined by a main body portion and by a boxlike lid carried by and hinged to the rear edge of the main body portion. A post is positioned at each end of the upper edge of the front panel of the main body, the posts formed by integral, folded panel portions. The boxlike lid carries lid guide panels within it for the purpose of guiding the lid to its desired closed position. The guide panels also cooperate with the posts to frictionally maintain the boxlike lid in its closed positions.

Figure 1:
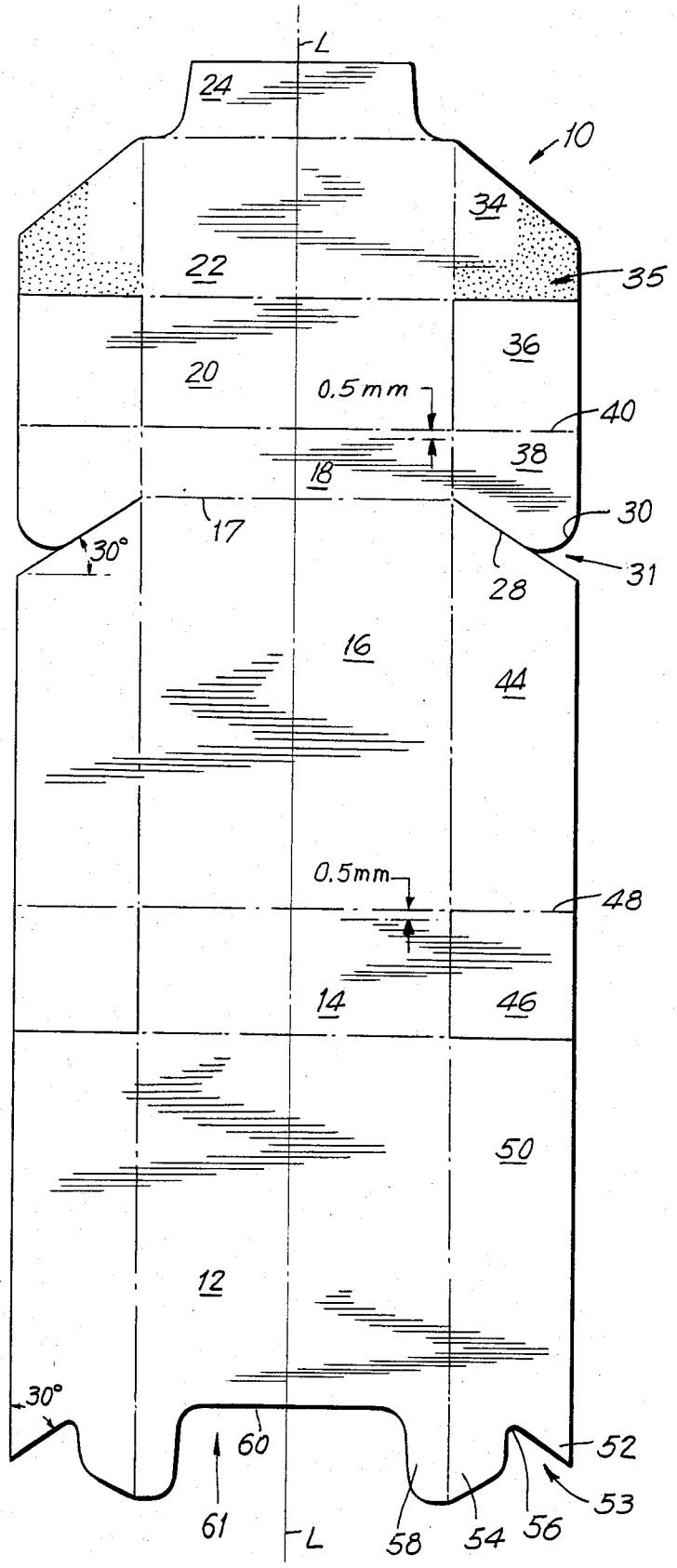
FIG. 1 is a plan view of a single or one-piece blank of paperboard, cardboard or similar material which is suitably cut and provided with hinge lines to form, when folded, the container of this invention.

Referring now to FIG. 1 of the drawings, the numeral 10 denotes generally the blank from which the container of this invention is formed. The blank is formed of cardboard, paperboard, or other stiff, resilient and foldable material. The imaginary axis L—L denotes the longitudinal axis of the blank, and the reader will observe that the blank exhibits mirror symmetry about this axis, i.e., the configuration of the right hand portion of the blank, if folded about axis L—L, would exactly match the configuration of the left portion of the blank. In the following description of the blank, as well as of the completed container, the term upper will refer to the upper portions of the blank or any part thereof, while the term lower will refer to the lower portions of the blank or any part thereof. Similarly, the term inner will refer to portions towards axis L—L, while the term outer will refer to portions more remote from axis L—L.

In FIG. 1, the dashed lines indicate fold or hinge axes, while the solid lines indicate cut lines extending completely through the blank. Further, the adjectives front, bottom, etc. will also refer to, in describing FIG. 1, those portions of the container defined by the blank after its folding.

The numeral 12 denotes a front wall, the numeral 14 a bottom wall, the numeral 16 a rear wall, the numeral

17 a boxlike lid hinge axis, the numeral 18 a rear lid wall, the numeral 20 a top lid wall, the numeral 22 a front lid wall and the numeral 24 a lid edge reinforcing panel. The numeral 34 denotes a lid side wall, the numeral 36 a lid stiffener panel, the numeral 38 a lid guide panel, the numeral 44 a rear wall side panel, the numeral 46 a bottom stiffener panel, and the numeral 50 a front wall side panel. The reader will observe that the numerals 34–50 refer to portions to the right of axis L—L and that, because of the mirror symmetry noted above, these numerals also describe their respective counterparts to the left axis L—L. The numeral 30 denotes a curved portion at the lower outer portion of lid guide panel 38, while the numeral 28 denotes a cut extending as indicated between panels 38 and 44. The numeral 31 denotes a recess between portion 30 and the extension of cut 28. Hinge line 40, which is located between lid stiffener panel 36 and lid guide panel 28, is depressed slightly, as for example 0.5 mm. from the hinge line joining walls 20 and 18. Similarly, hinge line 48, located between panels 44 and 46, is slightly raised , as for example 0.5 mm. from the hinge line joining panels 16 and 14. The numeral 52 denotes the lower, outer portion of front wall side panel 50, the numeral 53 denoting a central recess of relief at the bottom portion of panel 50, while numeral 54 denotes a first post-forming zone or area, this zone being the lower, inner portion of panel 50. Typically, the radius of curvature 56 at the juncture of portions 52 and 54 may be approximately $\frac{1}{8}$ inch. The numeral 58 denotes a second post forming zone, defined by the lower right hand portion of front wall 12, the lowermost portion of front wall 12 being recessed and having a lower edge denoted by the numeral 60, the recess or the relief being denoted by the numeral 61. As will later be explained, post-forming portions 54 and 58 are folded to form a right angle post.

The stippling denoted by the numeral 35 denotes an adhesive placed on one (the inner) surface of panel 34. On panel 34, the adhesive is applied to the outer and lowermost portions only, for a purpose later to be described. Alternatively, the adhesive 35 may be applied in a corresponding pattern to flap 38.

Figure 3:
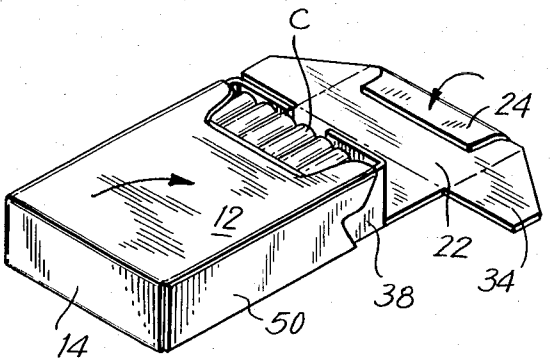
FIG. 2–4 illustrate the formation of the container and its typical contents to form a package.
Figure 4:
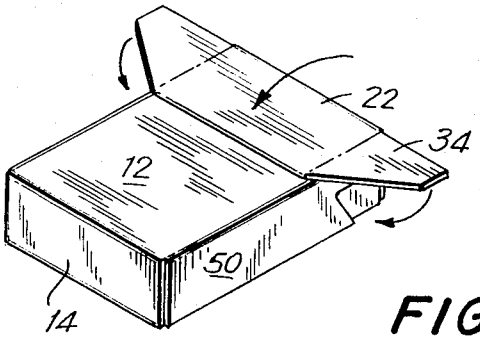
Figure 2:
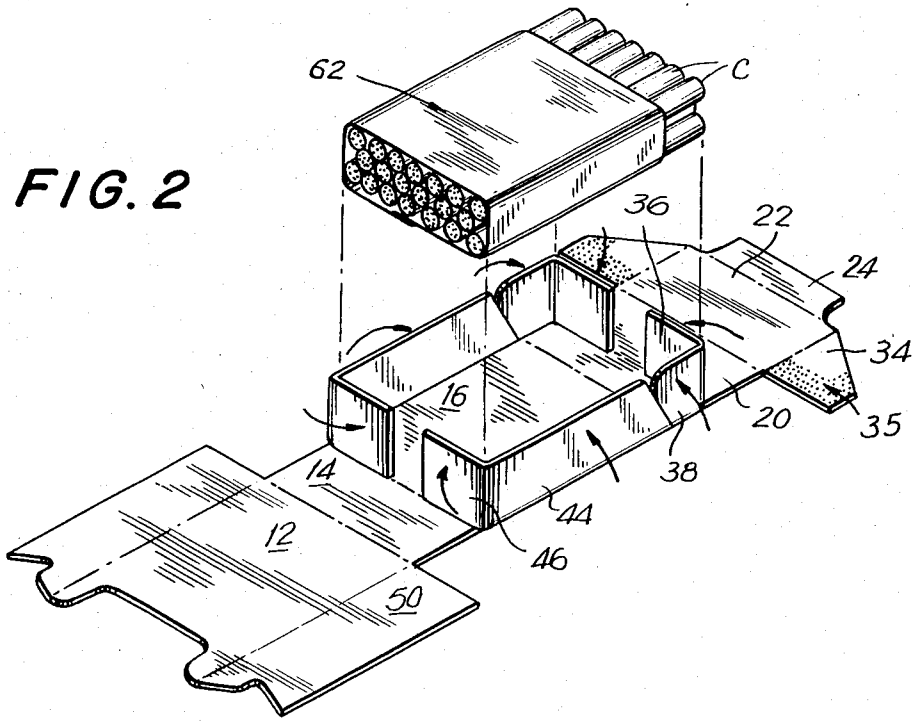
Figure 5:
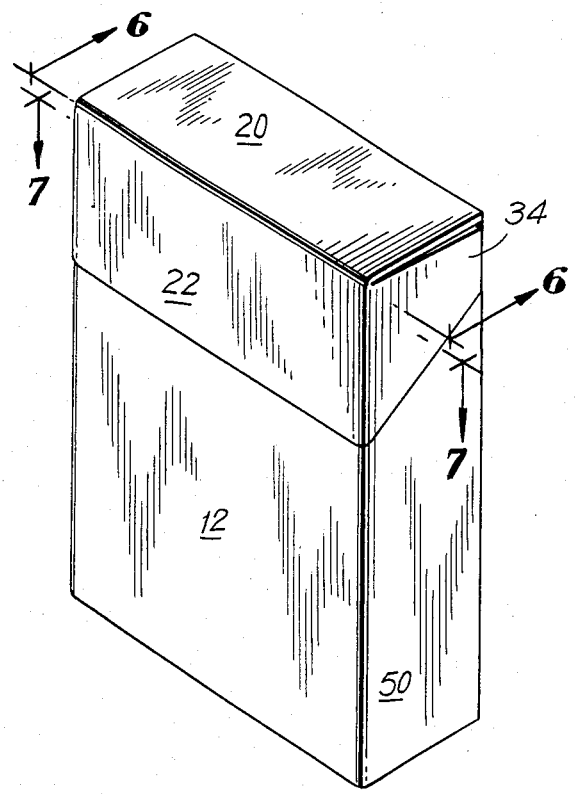
FIG. 5 is a perspective view of the container/package in its closed configuration.

Referring now to FIGS. 2–4 of the drawings, one method of forming the container/package of the present invention, filled with cigarettes for example, is illustrated. Firstly, a group 62 of cigarettes or other rod-like objects C is formed into a rectangular package, as may be accomplished by wrapping metal foil around the cigarettes to form a parallelepiped shaped bundle. The package is placed on rear wall 16, and side panels 44 and bottom stiffener panels 46 folded as indicated at FIG. 2. Next, front wall 12 and bottom wall 14 folded upwardly and front side walls 50 adhesively secured to side panels 44, with bottom stiffener panels 46 resting against bottom wall 14. Next, the boxlike lid elements 18, 20, 22, 24 and their associated side wall and panel elements are hinged and folded and secured together as by adhesive to form the completed container shown at FIG. 5. It will be understood that lid stiffening panels 36 need not be adhesively secured to top lid panel 20.

Figure 8:
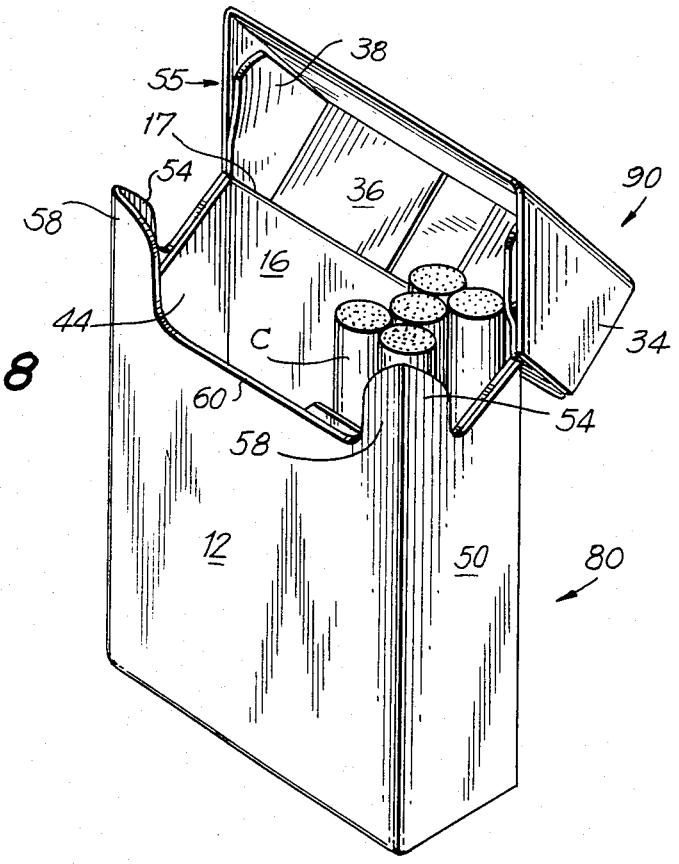
FIG. 8 is a perspective view of the container in its open configuration with some of its typical contents having been removed.

Referring now to FIG. 8 of the drawings, the container is illustrated in its open position, with some of the cylindrical objects, such as cigarettes, having been removed. The numeral 80 denotes the main or lower portion of the container and the numeral 90 denotes the upper, boxlike lid pivoted or hinged along 17 to the lower portion. Viewing now the right hand portion of the opened container, the numeral 58 denotes one post-defining portion, while the numeral 58 denotes a second post-defining portion. Portions 54 and 58 define one right angle post, while towards the left of FIG. 8 portions 58 and 54 of another post are seen.

Figure 7:
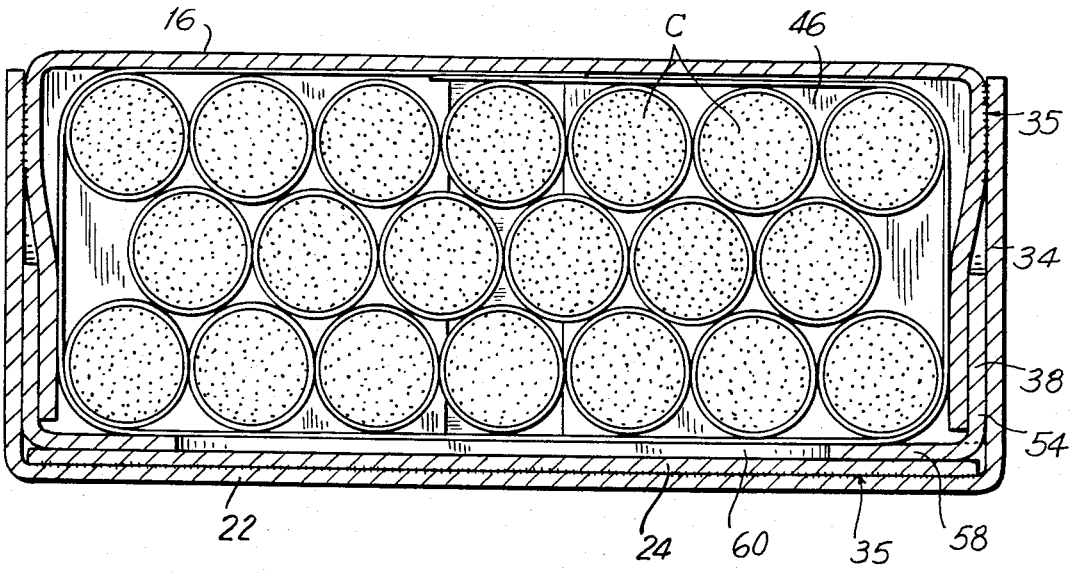
FIG. 7 is a view taken along section 7—7 of FIG. 5.

The lid edge reinforcing panel 24 is bent over its indicated fold connection with front lid wall 22. and fastened, as by adhesive 35, to the interior of wall 22 as may be seen at FIGS. 3 and 7. Similarly, lid stiffener panels 36 lie against the interior of top lid wall 20. In practice, the bottom wall 14 is stiffened by panels 46, while the top lid wall 20 is stiffened by panels 36, although panels 36 and 46 could be omitted from the blank and completed structure if desired.

The rearmost, uppermost portion of each lid guide panel 38 is secured as by adhesive pattern 35 to a corresponding lid side wall 34, leaving a space, termed a gap space and denoted by the numeral 55 (see FIG. 8) between the front of each lid side wall 34 and each lid guide panel 38. Portion 54 of each post slidingly and frictionally fits into this gap space when the boxlike lid 90 is closed. As may be readily visualized by reference to FIGS. 6 and 7, each post portion 54 is frictionally sandwiched by panels 38 and 34, thus frictionally secured the lid 90 to main container portion 80 in the closed position.

The reader will note that the side walls 34 and 38 of boxlike lid 90 define a double thickness. Further, side walls 50 and 44 of lower container portion 80 also define a double thickness of the sheet material from which the container is formed. The post-defining portions 54 of container portion 80, in the closed condition of the boxlike lid 82, are parallel to the side walls 34, 38 and thus, in the closed condition, define a third thickness as may be seen at FIGS. 6 and 7. Clearly, some provision must be made for accommodating the third thickness of the boxlike lid side walls in the closed condition if there is to be a minimum of distortion, wrinkling or mismatching of the several planar surfaces of the container.

Figure 6:
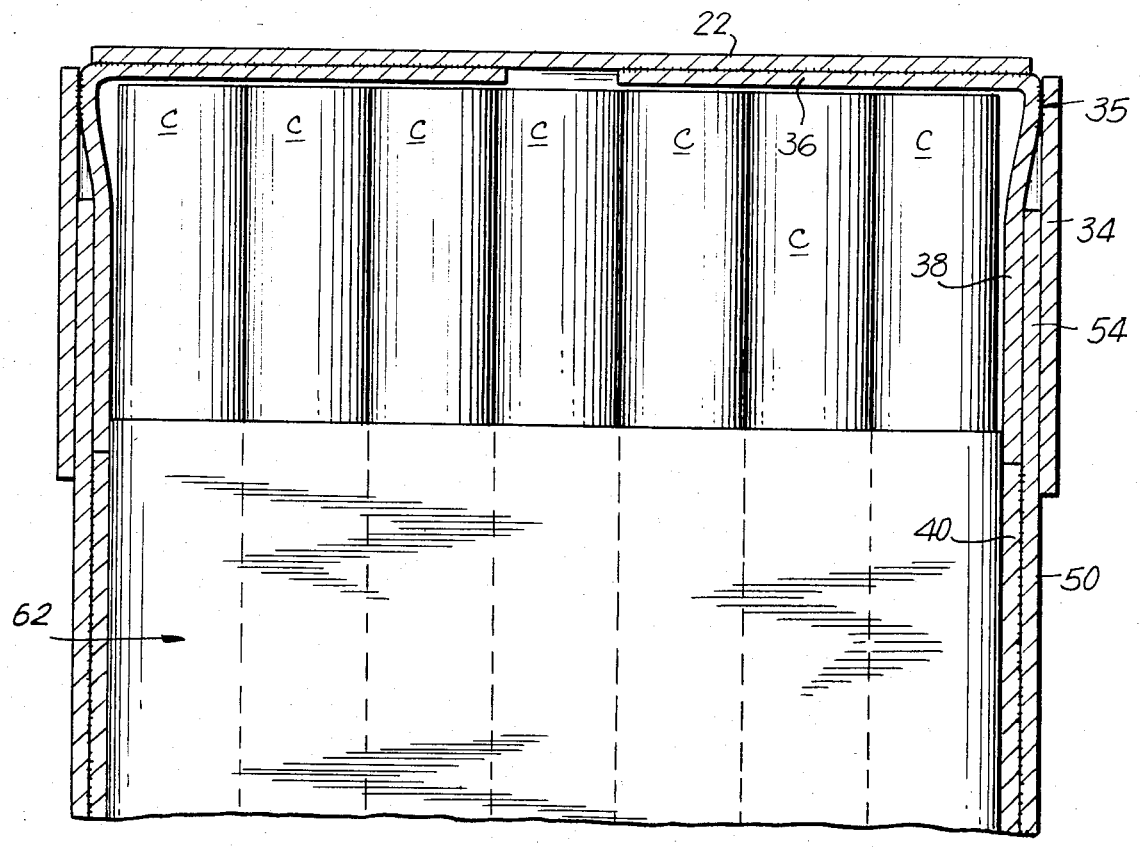
FIG. 6 is a view taken along section 6—6 of FIG. 5.

According to the practice of this invention, the lid guide panels 38 are attached, as by adhesive, to the rear portion only of the lid side walls 34, to thereby define the noted front gap space 55. The shape and location of an adhesive pattern on the lid side wall panels 34, to yield the desired gap space, is indicated at FIG. 1 by the stippled pattern 35 on lid side panels 34. With the gap space, the double thickness side walls 44, 50 of container portion 80 are displaced by only a single thickness of the sheet material from the thickness 34, 54 of the boxlike lid in the closed condition. This is seen at FIG. 6. The third sheet thickness of box-like lid 90 in the closed condition, defined by lid guide panels 38, lies inside the post portions 54 and does not tend to bulge the sides of the boxlike lid in the closed condition. The exact shape of the adhesive pattern on flap 34, or on flap 38, is such that post portions 54 are free to frictionally enter the gap spaces 55.

Figure 9:
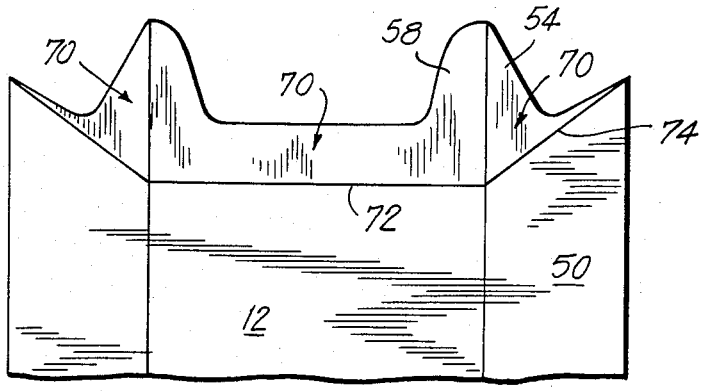
FIG. 9 is a partial view illustrating a modification wherein debossing is applied to a portion of the blank for forming the container.

FIG. 9 illustrates a modification wherein the exterior upper portion of front panel 12, the exterior upper portions of outer sidewall panels 50 and the exterior of post-forming segments 54 and 58 are all debossed. The debossed portions or zones are denoted by the numeral 70. The numeral 72 denotes the lowermost boundary of debossing on panel 12 and the numeral 74 denotes the lowermost boundary of debossing on outer sidewalls 50. when in the closed position, the lower edge of lid 22 is substantially coincident with boundary 72, while the lower edge of lid 22 is substantially coincident with boundary 72, while the lower edge of each lid sidewall 34 is substantially coincident with a respective boundary 74.

Debossing is well known in the paperboard art and may be considered as a compression process resulting in a thinner paperboard. Namely, those portions of paperboard sheet which are debossed are thinner than the remaining or not debossed portions.

The dobossing of the container of this invention gives the appearance of a setting back, inwardly of the container portion 80, of the debossed portions, and thus creates at least partially the illusion that the carton lower portion is formed of more than a single sheet of paperboard. Yet another advantage of the debossing modification will not be set out, in connection with another important feature of the invention.

From a consideration of FIG. 6 of the drawings, it is seen that the post portion 54, in the closed portion of boxlike lid 90, is between the outer side panel 34 of the lid and inner side lid panel 38. There exists a single thickness of the paperboard extending out from the sides 50. In a typical prior art construction of a similar container, such as that shown in U.S. Pat. No. 2,163,828 issued to Chalmers, the sides of the boxlike lid are also defined by two panels, but these both lie outside of the corresponding post panel. This results in a double thickness of the paperboard extending out from the sides of the container in the closed position of the lid. Accordingly, the construction of the present invention yields a smoother sided container than that of the prior art.

Figure 10:
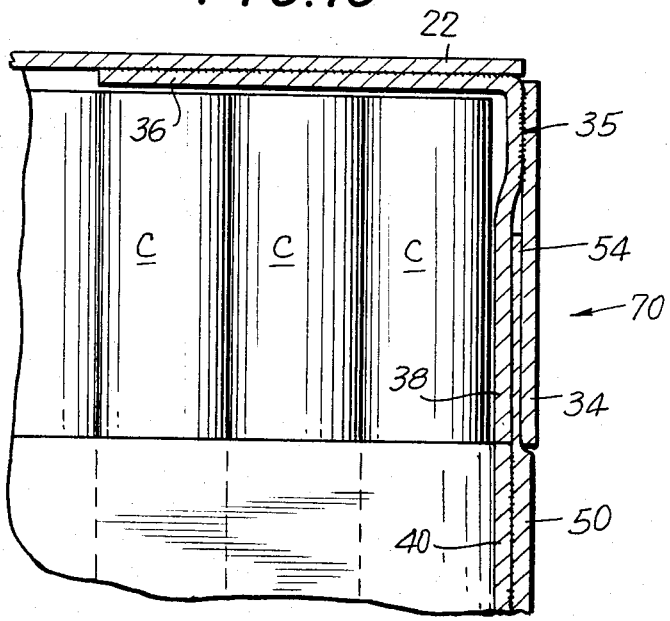
FIG. 10 is a partial cross-sectional view, similar to that of FIG. 6, and illustrates the effect of the debossing modification of FIG. 9.

In the event that debossing is employed, as indicated at FIG. 9, the post portions 54, being of lesser thickness than those of the other container panels, the outer side walls 34 of the lid are now spaced less than a thickness of the paperboard from sidewalls 50 of main container portion 80. This permits a yet smoother side wall appearance in the closed container, as may be seen by comparison with FIG. 10 with the right hand portion of FIG. 6. The debossed upper region 70 of front panel 12 permits front panel 22 of boxlike lid 90 to lie closer to the remainder of the front panel when the lid is closed, thereby presenting a smoother appearance to the front of the closed carton or container.

It is claimed:

1. A one-piece blank formed of stiff, resilient and foldable sheet material, such as paperboard, the blank being provided with a plurality of fold lines and cut lines to thereby define a plurality of walls and panels and adapted to form a container of rectangular parallelepiped shape having a hinged lid, the lid when closed forming a portion of the container, the blank being of generally rectangular form, the blank having mirror symmetry with respect to its longitudinal axis, the blank including, in series from its upper end to its lower end, a front lid wall, the latter hinged to a top lid wall, the latter hinged to a rear lid wall, the latter hinged to a rear wall, the latter hinged to a bottom wall, the latter hinged to a front wall, the five recited hinge connections being parallel to each other, the front lid wall carrying a lid side wall hinged to each lid wall side, the rear lid wall carrying a lid guide panel hinged to each side of the rear lid wall, the rear wall carrying a rear wall side panel hinged to each side thereof, the front wall carrying a front wall side panel hinged to each side thereof, the bottom edge of the front wall being centrally relieved to form a recess, the remaining, non-relieved bottom edge of the front wall defining first post-defining portions, the bottom edges of the front wall side panels being centrally relieved, the axially innermost portion of the bottm edge of the front wall side panels defining second post-defining portions, each lid guide panel being separated from its adjacent rear wall side panels by a cut line, each cut line forming an angle with respect to the axis of the hinge joining the rear lid wall to the rear wall, the widths of the lid side walls, the lid guide panels, rear side wall panels and the front wall side panels being substantially the same.

2. The blank of claim 1 wherein the top of the front lid wall hingedly carries a lid edge reinforcing panel.

3. The blank of claim 1 wherein the top of each lid guide panel hingedly carries a lid stiffener panel.

4. The blank of claim 1 wherein the top edge of each lid guide panel is downwardly displaced from the hinge between the top lid wall and the rear lid wall.

5. The blank of claim 1 wherein the bottom of each rear wall side panel is displaced upwardly from the hinge between the rear wall and the bottom wall.

6. The blank of claim 1 wherein the axially outermost, lower portion of each lid guide panel is rounded.

7. The blank of claim 1 wherein the first and second post-defining portions and the central lower portion of the front wall between the first post-defining portions are debossed.

8. A container of generally rectangular parallelepiped shape and formed from stiff, resilient and foldable sheet material, such as cardboard, the container having rectangular front, rear, side, top and bottom walls, the top of the container having a boxlike lid hingedly connected to the container along a hinge line located below the top of the container and on the rear container wall, the portion of the container between its top wall and said hinge line defining a rear lid wall, the upper ends of the side walls being centrally relieved, the upper edge of the front wall being centrally relieved, the non-relieved upper edge of the front wall defining two first post-defining portions, the non-relieved and frontal positioned upper side wall edges defining two second post-defining portions, to thereby define a right angular post at the top edges of the front and side walls, a lid guide panel secured to the rearmost portion of each interior side wall of the boxlike lid and generally parallel thereto and thereby defining a gap space between each lid guide panel and each side wall of the boxlike lid, each second post-defining portion moving into and out of its respective gap space in the box-like lid, the front wall of the boxlike lid and the lower front end of each lid guide panel being so dimensioned that during closing of the lid the lower edge of the front wall of the boxlike lid passes clear of the tops of the right angular posts, the lower edge of the front wall of the box-like lid, in the closed condition, being lower than the hinge axis of the boxlike lid.

9. The container of claim 8 wherein the lower front portion of each lid guide panel is rounded.

10. The container of claim 8 wherein the lower edges of the sides of the boxlike lid are straight.

11. The container of claim 8 wherein a portion of the front container wall is in surface contact with the interior of the lid front panel is debossed, the debossed portion thereby yielding the appearance of a portion inwardly displaced from the non lid portions when the boxlike lid is opened.

12. The container of claim 8 wherein the portions of the container side walls are in surface contact with the interior of the sides of the lid are debossed, the debossed portions thereby yielding the appearance of portions inwardly displaced from the non lid portions when the boxlike lid is opened.

* * * * *